US012677949B2

(12) United States Patent
Chen et al.

(10) Patent No.: US 12,677,949 B2
(45) Date of Patent: Jul. 14, 2026

(54) SLIDE RAIL ASSEMBLY

(71) Applicants: KING SLIDE WORKS CO., LTD., Kaohsiung City (TW); KING SLIDE TECHNOLOGY CO., LTD., Kaohsiung City (TW)

(72) Inventors: Ken-Ching Chen, Kaohsiung City (TW); Shun-Ho Yang, Kaohsiung City (TW); Wei-Chen Chang, Kaohsiung City (TW); Chun-Chiang Wang, Kaohsiung City (TW)

(73) Assignees: KING SLIDE WORKS CO., LTD., Kaohsiung City (TW); KING SLIDE TECHNOLOGY CO., LTD., Kaohsiung City (TW)

( * ) Notice: Subject to any disclaimer, the term of this patent is extended or adjusted under 35 U.S.C. 154(b) by 61 days.

(21) Appl. No.: 19/019,388

(22) Filed: Jan. 13, 2025

(65) Prior Publication Data

US 2025/0375035 A1 Dec. 11, 2025

(30) Foreign Application Priority Data

Jun. 7, 2024 (TW) ..... 113121462

(51) Int. Cl.
*A47B 96/06* (2006.01)
*A47B 88/40* (2017.01)

(52) U.S. Cl.
CPC ..... *A47B 96/06* (2013.01); *A47B 88/40* (2017.01)

(58) Field of Classification Search
CPC ..... A47B 96/06; A47B 88/40
USPC ..... 248/429
See application file for complete search history.

(56) References Cited

U.S. PATENT DOCUMENTS

| | | | | |
|---|---|---|---|---|
| 6,883,884 | B2 | 4/2005 | Chen | |
| 9,867,462 | B2 * | 1/2018 | Chen | A47B 88/427 |
| 12,490,831 | B2 * | 12/2025 | Chen | A47B 88/477 |
| 12,571,425 | B2 * | 3/2026 | Chen | A47B 88/50 |
| 12,604,981 | B2 * | 4/2026 | Chen | A47B 88/473 |

FOREIGN PATENT DOCUMENTS

| | | |
|---|---|---|
| EP | 4 035 568 | 8/2022 |
| EP | 4 548 808 | 5/2025 |
| TW | 1842640 | 5/2024 |

* cited by examiner

*Primary Examiner* — Anita M King
(74) *Attorney, Agent, or Firm* — Winston Hsu

(57) ABSTRACT

A slide rail assembly includes a first rail, a second rail, a blocking feature, a first operating member, a second operating member, an auxiliary member and a locking member. The blocking feature is arranged on the first rail. The first operating member, the second operating member, the auxiliary member and the locking member are movably located on the second rail. The blocking feature is configured to block the locking member for preventing the second rail from displacing from a predetermined position. The auxiliary member is configured to block the first operating member, thereby preventing the first operating member from driving the locking member. The second operating member is configured to be operated to drive the auxiliary member to prevent the auxiliary member from blocking the first operating member, thereby allowing the first operating member to drive the locking member for allowing the second rail to displace from the predetermined position.

20 Claims, 8 Drawing Sheets

SLIDE RAIL ASSEMBLY

BACKGROUND OF THE INVENTION

1. Field of the Invention

The present invention relates to a slide rail mechanism, and more specifically, to a slide rail assembly capable of terminating a blocking relationship between two slide rails through operation of two operating members when one of the two slide rails is located at a predetermined position relative to the other one of the two slide rails.

2. Description of the Prior Art

In U.S. Pat. No. 6,883,884 B2, it discloses a latch assembly adapted for a slide rail device. The slide rail device includes a first rail and a second rail displaceable relative to each other. The latch assembly is arranged on the first rail, and a latch seat is arranged on the second rail. When the first rail is located at a retracted position relative to the second rail, the latch assembly engages with the latch seat to retain the first rail at the retracted position. Furthermore, the latch assembly includes two actuating members, e.g., a first actuating member and a second actuating member. The first actuating member and the second actuating member include a first hook and a second hook, respectively. When only the first actuating member is pressed, the first hook disengages from the latch seat, while the second hook remains engaged with the latch seat, thereby still preventing the first rail from displacing relative to the second rail away from the retracted position. Conversely, when only the second actuating member is pressed, the second hook disengages from the latch seat, while the first hook remains engaged with the latch seat, thereby still preventing the first rail from displacing relative to the second rail away from the retracted position.

From the above, it can be understood that, to allow the first rail to displace relative to the second rail away from the retracted position, both the first actuating member and the second actuating member have to be pressed to disengage the first hook and the second hook from the latch seat.

However, in order to meet different requirements, it becomes an important topic to provide another slide rail product.

SUMMARY OF THE INVENTION

It is an objective of the present invention to provide a slide rail assembly capable of terminating a blocking relationship between two slide rails through operation of two operating members when one of the two slide rails is located at a predetermined position relative to the other one of the two slide rails.

According to an aspect of the present invention, a slide rail assembly includes a first rail, a second rail, a blocking feature, a first operating member, a second operating member, an auxiliary member and a locking member. The second rail is displaceable relative to the first rail. The blocking feature is arranged on the first rail. The first operating member is movably located on the second rail. The second operating member is movably located on the second rail. The auxiliary member is movably located on the second rail. The locking member is movably located on the second rail. When the second rail is located at a predetermined position relative to the first rail, the blocking feature is configured to block the locking member in a locking state for preventing the second rail from displacing away from the predetermined position. When the auxiliary member is in a first state, the auxiliary member is configured to block the first operating member, thereby preventing the first operating member from being operated to drive the locking member from the locking state to an unlocking state. The second operating member is configured to be operated to drive the auxiliary member from the first state to a second state for preventing the first operating member from being blocked by the auxiliary member, thereby allowing the first operating member to be operated to drive the locking member from the locking state to the unlocking state for allowing the second rail to displace away from the predetermined position.

According to another aspect of the present invention, a slide rail assembly includes a first rail, a second rail, a blocking feature, a first operating member, a second operating member, an auxiliary member and a locking member. The second rail is displaceable relative to the first rail. The blocking feature is arranged on the first rail. The first operating member is movably located on the second rail. The second operating member is movably located on the second rail. The auxiliary member is movably located on the second rail. The locking member is movably located on the second rail. When the second rail is located at a predetermined position relative to the first rail, the blocking feature is configured to block the locking member in a locking state for preventing the second rail from displacing away from the predetermined position. When the auxiliary member is in a first state, the auxiliary member is configured to block the first operating member, thereby preventing the first operating member from being pressed along a first predetermined direction to drive the locking member from the locking state to an unlocking state. When the second operating member is pressed along a second predetermined direction opposite to the first predetermined direction, the second operating member is configured to drive the auxiliary member from the first state to a second state, thereby allowing the first operating member to be pressed along the first predetermined direction to drive the locking member from the locking state to the unlocking state.

According to another aspect of the present invention, a slide rail assembly includes a first rail, a second rail, a blocking feature, a first operating member, a second operating member, an auxiliary member, a locking member and a resilient member. The second rail is displaceable relative to the first rail. The blocking feature is arranged on the first rail. The first operating member is movably located on the second rail. The second operating member is movably located on the second rail. The auxiliary member is movably located on the second rail. The auxiliary member includes a main body portion, a blocking portion and an actuating portion. The blocking portion and the actuating portion are arranged on the main body portion. The locking member is movably located on the second rail. When the second rail is located at a predetermined position relative to the first rail, the blocking feature is configured to block the locking member in a locking state for preventing the second rail from displacing away from the predetermined position. When the auxiliary member is in a first state, the blocking portion of the auxiliary member is configured to block a corresponding portion of the first operating member, thereby preventing the first operating member from being pressed along a first predetermined direction to drive the locking member. When the second operating member is pressed along a second predetermined direction opposite to the first predetermined direction, the second operating member is configured to drive the auxiliary member from the first state to a second state for preventing the corresponding portion of the first operating member from being blocked by the blocking portion of the auxiliary member, thereby allowing the first operating member to be pressed along the first predetermined direction to drive the locking member from the locking state to an unlocking state for allowing the second rail to displace away from the predetermined position. The resilient member is configured to provide a resilient force for resiliently retaining the locking member in the locking state, and the locking member in the locking state is configured to support the first operating member.

In summary, the present invention uses the auxiliary member as a safety lock to prevent the first operating member from being operated to drive the locking member from the locking state to the unlocking state if the second operating member is not operated properly. Accordingly, only after the second operating member has been operated to drive the auxiliary member, can the first operating member be operated to drive the locking member to the unlocking state, thereby ensuring operational safety.

These and other objectives of the present invention will no doubt become obvious to those of ordinary skill in the art after reading the following detailed description of the preferred embodiment that is illustrated in the various figures and drawings.

DETAILED DESCRIPTION

In the following detailed description of the preferred embodiments, reference is made to the accompanying drawings which form a part hereof, and in which is shown by way of illustration specific embodiments in which the invention may be practiced. In this regard, directional terminology, such as "top", "bottom", "left", "right", "front", "back", etc., is used with reference to the orientation of the Figure(s) being described. The components of the present invention can be positioned in a number of different orientations. As such, the directional terminology is used for purposes of illustration and is in no way limiting. Accordingly, the drawings and descriptions will be regarded as illustrative in nature and not as restrictive. Also, if not specified, the term "connect" is intended to mean either an indirect or direct mechanical connection. Thus, if a first device is connected to a second device, that connection may be through a direct mechanical connection, or through an indirect mechanical connection via other devices and connections.

Figure 1:
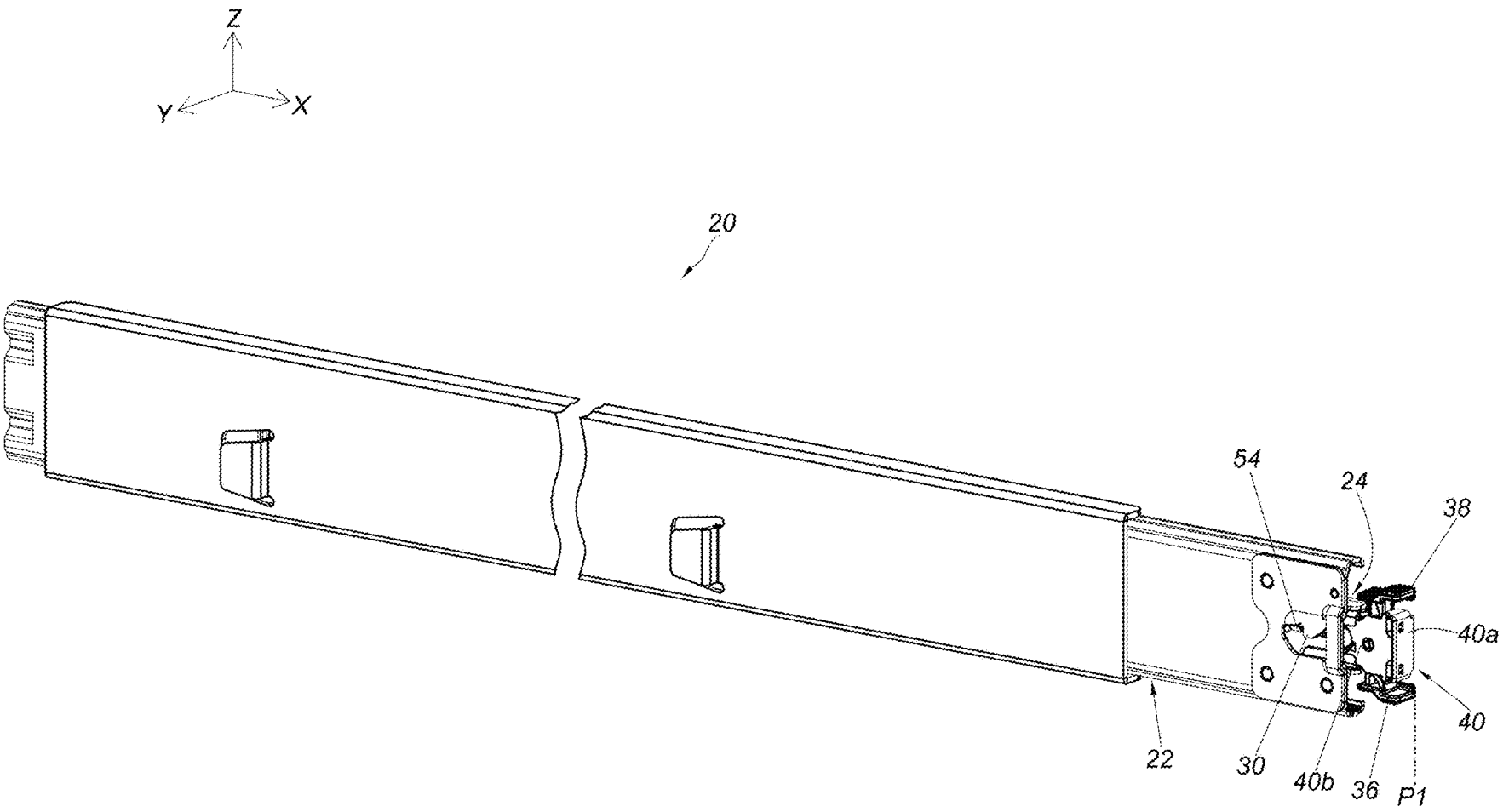
FIG. 1 is a schematic diagram of a slide rail assembly according to an embodiment of the present invention.
Figure 2:
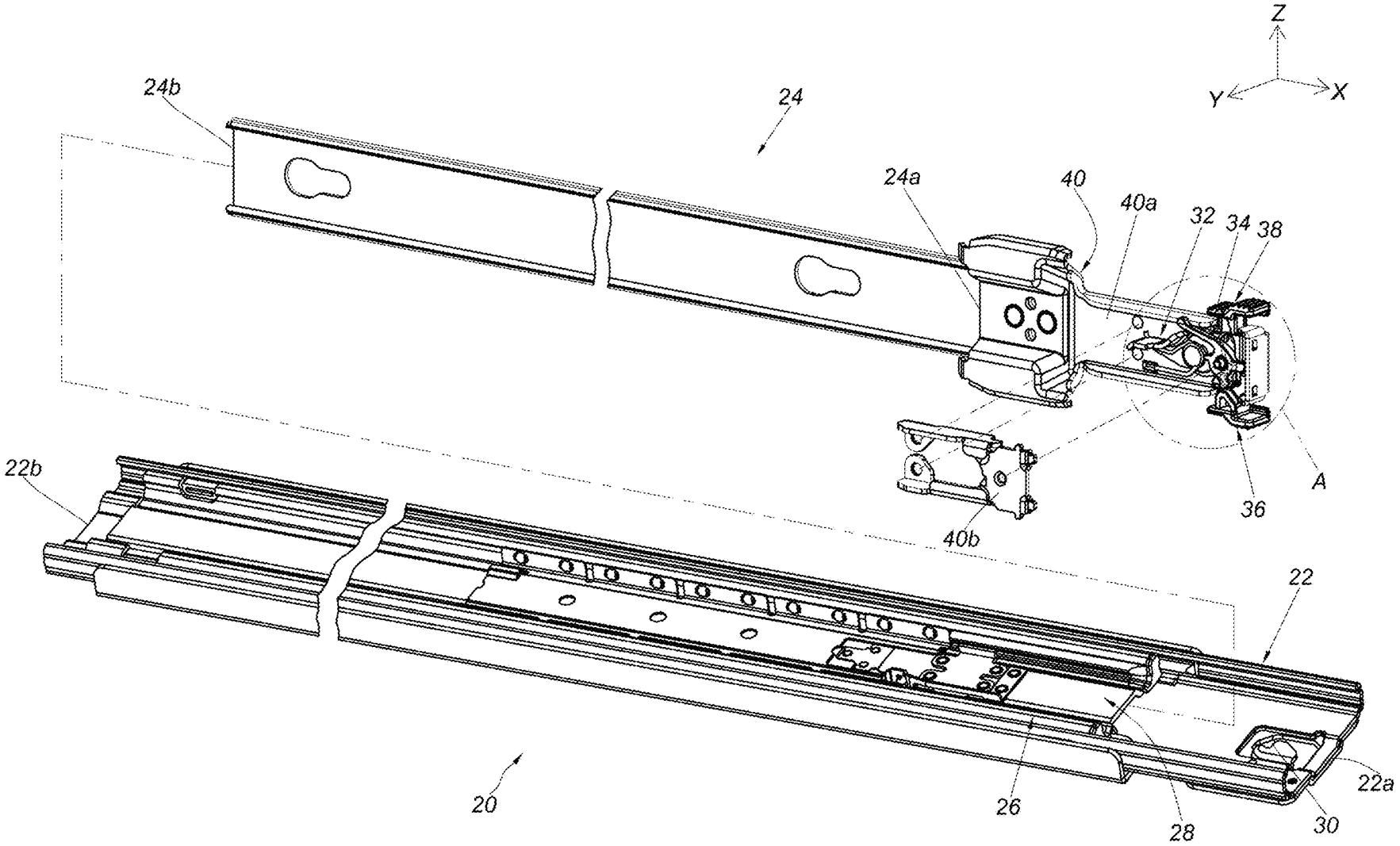
FIG. 2 is an exploded diagram of the slide rail assembly according to the embodiment of the present invention.
Figure 3:
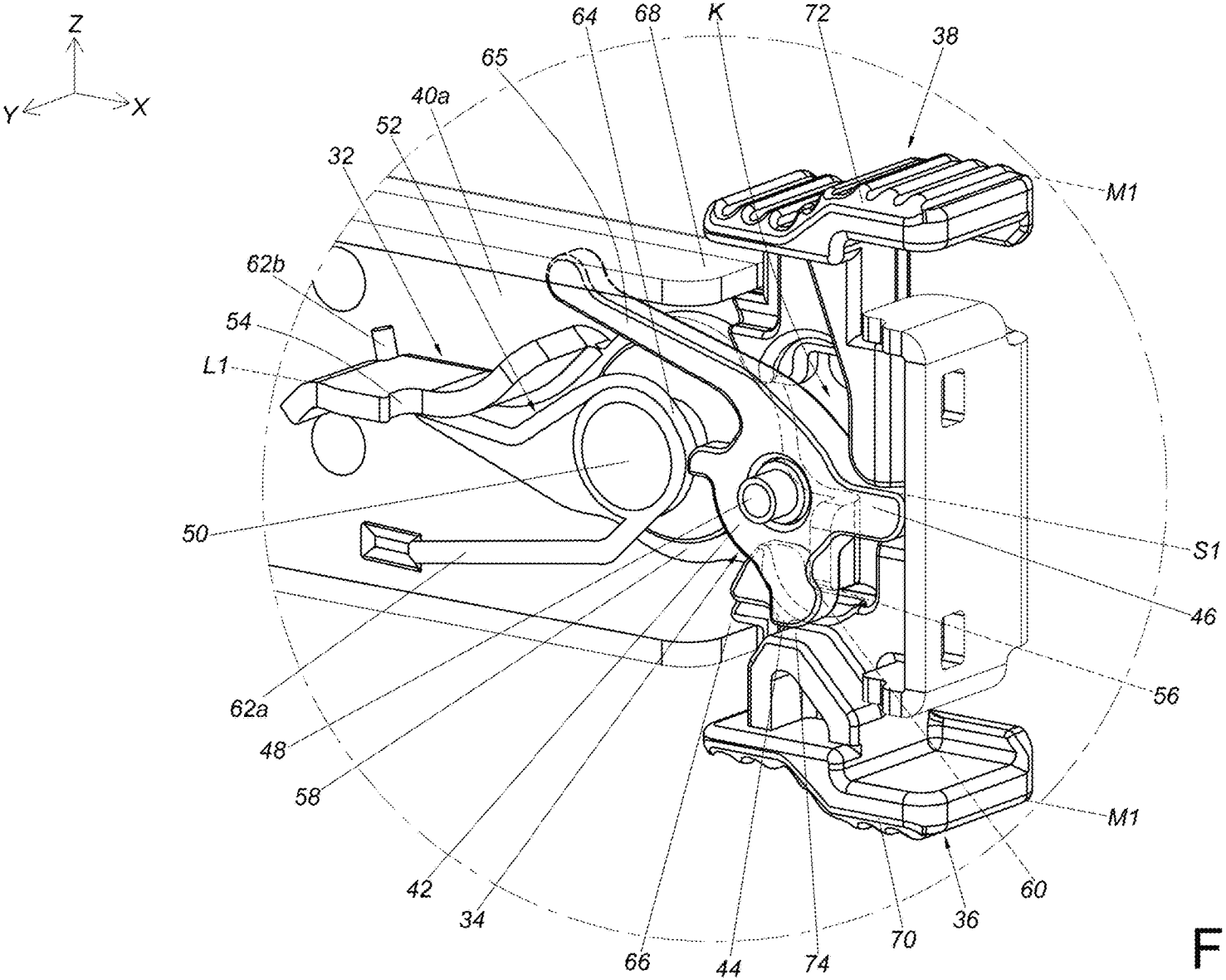
FIG. 3 is an enlarged diagram of an A portion of the slide rail assembly shown in FIG. 2 according to the embodiment of the present invention.

As shown in FIG. 1 to FIG. 3, a slide rail assembly 20 includes a first rail 22 and a second rail 24 displaceable relative to the first rail 22 along a longitudinal direction. Preferably, the slide rail assembly 20 further includes a third rail 26 movably mounted between the first rail 22 and the second rail 24. The third rail 26 includes a channel 28 for movably mounting the second rail 24. In this embodiment, by way of example, the longitudinal direction can be defined by a length direction of a slide rail, e.g., the first rail 22, the second rail 24 or the third rail 26, and parallel to an X axis. A transverse direction can be defined by a lateral direction or a width direction of the slide rail, e.g., the first rail 22, the second rail 24 or the third rail 26, and parallel to a Y axis. A vertical direction can be defined by a height direction of the slide rail, e.g., the first rail 22, the second rail 24 or the third rail 26, and parallel to a Z axis.

Furthermore, the slide rail assembly 20 further includes a blocking feature 30, a locking member 32, an auxiliary member 34 and two operating members. The locking member 32 is configured to cooperate with the blocking feature 30. The two operating members, for example, can be a first operating member 36 and a second operating member 38.

The blocking feature 30 is arranged on one of the first rail 22 and the second rail 24. In this embodiment, by way of example, as shown FIG. 2, the blocking feature 30 is arranged on the first rail 22. The blocking feature 30 can be disposed on the first rail 22 directly or indirectly. In this embodiment, by way of example, the blocking feature 30 can be a slot wall or a hole wall. However, the present invention is not limited to this embodiment. For example, in another embodiment, the blocking feature 30 can be a protruding object. Preferably, the first rail 22 includes a first end portion 22*a* and a second end portion 22*b* opposite to the first end portion 22*a*. For example, the first end portion 22*a* and the second end portion 22*b* of the first rail 22 can be a front end portion and a rear end portion of the first rail 22, respectively. The blocking feature 30 is arranged on the first rail 22 and located adjacent to the first end portion 22*a* of the first rail 22.

The locking member 32, the auxiliary member 34, the first operating member 36 and the second operating member 38 are movably located on the other one of the first rail 22 and the second rail 24. In this embodiment, by way of example, the locking member 32, the auxiliary member 34, the first operating member 36 and the second operating member 38 are movably located on the second rail 24. Preferably, the second rail 24 includes a first end portion 24*a* and a second end portion 24*b* opposite to the first end portion 24*a*. For example, the first end portion 24*a* and the second end portion 24*b* of the second rail 24 can be a front end portion and a rear end portion of the second rail 24, respectively. The locking member 32, the auxiliary member 34, the first operating member 36 and the second operating member 38 are movably mounted on the second rail 24 and located adjacent to the first end portion 24*a* of the second rail 24.

Preferably, a shell member 40 is arranged on the second rail 24. The shell member 40 is connected, e.g., fixedly connected, to the first end portion 24*a* of the second rail 24 and can be considered as a part of the second rail 24. As shown in FIG. 2 and FIG. 3, the shell member 40 includes a first shell portion 40*a* and a second shell portion 40*b* connectable to the first shell portion 40*a*. Preferably, a receiving space is defined between the first shell portion 40*a* and the second shell portion 40*b*, and the locking member 32, the auxiliary member 34, the first operating member 36 and the second operating member 38 are movably arranged on the first shell portion 40*a* connected to the first end portion 24*a* of the second rail 24. Furthermore, the first shell portion 40*a* and the second shell portion 40*b* are configured to receive and/or cover at least a portion of the locking member 32, the auxiliary member 34, the first operating member 36 and/or the second operating member 38, thereby providing a protective effect. However, the present invention is not limited to this embodiment. For example, in another embodiment, the locking member 32, the auxiliary member 34, the first operating member 36 and the second operating member 38 can be arranged on the second rail 24 directly, without the need for the shell member 40, and located adjacent to the first end portion 24*a* of the second rail 24.

Figure 4:
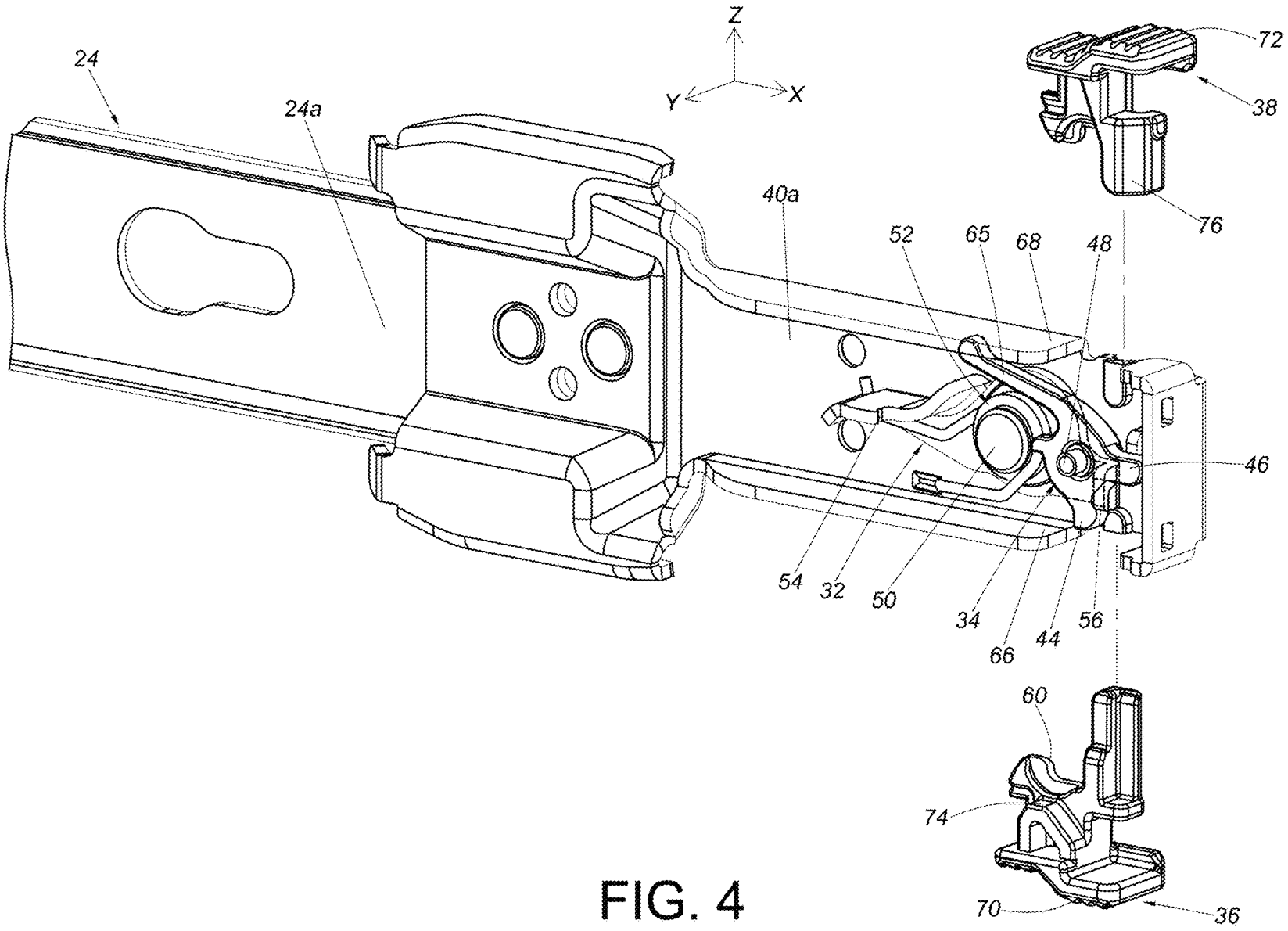
FIG. 4 is a partial exploded diagram of the slide rail assembly according to the embodiment of the present invention.

As shown in FIG. 3 and FIG. 4, the auxiliary member 34 includes a main body portion 42, a blocking portion 44 and an actuating portion 46. The main body portion 42 is pivotally connected to the second rail 24, e.g., via the first shell portion 40*a* connected to the second rail 24, by a first shaft 48. The blocking portion 44 and the actuating portion 46 are arranged on the main body portion 42. In this embodiment, by way of example, the blocking portion 44 and the actuating portion 46 extend from the main body portion 42 and are spaced apart from each other by a distance, and both the blocking portion 44 and the actuating portion 46 are protruding portions. However, the present invention is not limited to this embodiment.

Preferably, the locking member 32 is pivotally connected to the second rail 24, e.g., via the first shell portion 40*a* connected to the second rail 24, by a second shaft 50. The second shaft 50 and the first shaft 48 are oriented in a direction substantially parallel to the transverse direction or the lateral direction of the second rail 24, i.e., the Y axis.

Preferably, the slide rail assembly 20 further includes a resilient member 52, such that the locking member 32 can be retained in a locking state L1 in response to a resilient force provided by the resilient member 52. The locking member 32 in the locking state L1 is configured to support the first operating member 36 to retain the first operating member 36 in a first predetermined state M1.

Specifically, the locking member 32 includes a locking portion 54, a working portion 56 and a middle portion 58 located between the locking portion 54 and the working portion 56. The middle portion 58 is pivotally connected to the first shell portion 40*a*, which is connected to the second rail 24, by the second shaft 50. The working portion 56 of the locking member 32 in the locking state L1 is configured to support a predetermined portion 60 of the first operating member 36, e.g., by abutting against the predetermined portion 60 of the first operating member 36, thereby retaining the first operating member 36 in the first predetermined state M1.

Preferably, the resilient member 52 includes a first resilient portion 62*a*, a second resilient portion 62*b* and a mounting portion 64 connected between the first resilient portion 62*a* and the second resilient portion 62*b*. The first resilient portion 62*a* abuts against the shell member 40 connected to the second rail 24, e.g., the first shell portion 40*a* or the second shell portion 40*b*. The second resilient portion 62*b* abuts against the locking member 32. The mounting portion 64 is mounted on the second shaft 50.

Preferably, the auxiliary member 34 is retained in a first state S1 by a resilient force provided by a resilient feature 65. The actuating portion 46 of the auxiliary member 34 in the first state S1 is configured to support the second operating member 38, thereby retaining the second operating member 38 in the first predetermined state M1. In this embodiment, by way of example, the resilient feature 65 is a resilient arm extending from the main body portion 42 and away from the blocking portion 44 and the actuating portion 46, and the resilient feature 65 abuts against the shell member 40 on the second rail 24, e.g., the first shell portion 40*a* or the second shell portion 40*b*. However, the present invention is not limited to this embodiment. For example, in another embodiment, the resilient feature 65 can be a torsional spring, an extension spring, a compression spring, or any other elastomer.

Preferably, the resilient force provided by the resilient member 52 is greater than the resilient force provided by the resilient feature 65.

Preferably, the second rail 24 includes at least one restraining portion. In this embodiment, by way of example, as shown in FIG. 3, the shell member 40 connected to the second rail 24, e.g., the first shell portion 40*a*, includes a first restraining portion 66 and a second restraining portion 68, and the first restraining portion 66 and the second restraining portion 68 are configured to respectively restrain the first operating member 36 and the second operating member 38 in the first predetermined state M1.

Preferably, the first operating member 36 includes a first operating portion 70 for allowing a pressing operation of the first operating member 36, and the second operating member 38 includes a second operating portion 72 for allowing a pressing operation of the second operating member 38. The first operating portion 70 and the second operating portion 72 are located opposite each other. Specifically, the first operating portion 70 is located adjacent to a first height position, e.g., a lower position, relative to the second rail 24, and the second operating portion 72 is located adjacent to a second height position, e.g., a higher position, relative to the second rail 24.

Preferably, the main body portion 42 of the auxiliary member 34 is located within a predetermined space K defined between the first operating member 36 and the second operating member 38.

Figure 5:
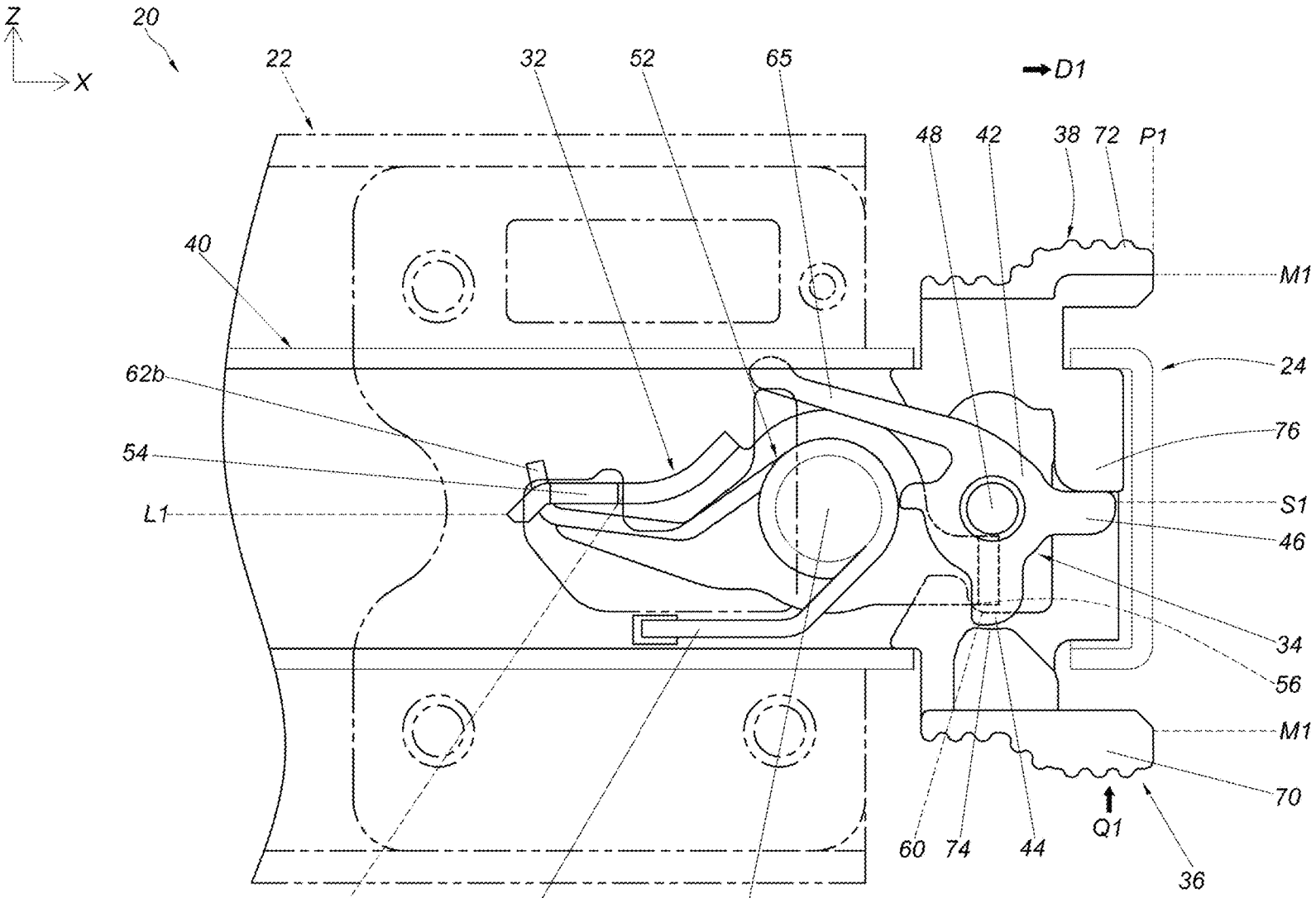
FIG. 5 is a partial diagram of the slide rail assembly, showing both a first operating member and a second operating member in a first predetermined state, with a second rail located at a predetermined position relative to a first rail, according to the embodiment of the present invention.

As shown in FIG. 5, both the first operating member 36 and the second operating member 38 are in the first predetermined state M1. When the second rail 24 is located at a predetermined position P1, such as a retracted position as shown in FIG. 5, relative to the first rail 22, the locking portion 54 of the locking member 32 in the locking state L1 can be blocked by the blocking feature 30 on the first rail 22, thereby preventing the second rail 24 from displacing away from the predetermined position P1 along an opening direction D1, which is parallel to the longitudinal direction. Specifically, when the locking member 32 is in the locking state L1, the locking portion 54 and the blocking feature 30 are corresponding to or aligned with each other along the longitudinal direction, i.e., the X axis, such that the blocking feature 30 is able to block the locking portion 54.

Furthermore, when the auxiliary member 34 is in the first state S1, the blocking portion 44 of the auxiliary member 34 blocks a corresponding portion 74 of the first operating member 36, thereby preventing the first operating member 36 from being operated, e.g., pressed along a first predetermined direction Q1, to drive the locking member 32 away from the locking state L1. Specifically, when the auxiliary member 34 is in the first state S1, the blocking portion 44 of the auxiliary member 34 and the corresponding portion 74 of the first operating member 36 are corresponding to or aligned with each other along the height direction, i.e., the Z axis, such that the blocking portion 44 of the auxiliary member 34 is able to block the corresponding portion 74 of the first operating member 36.

Figure 6:
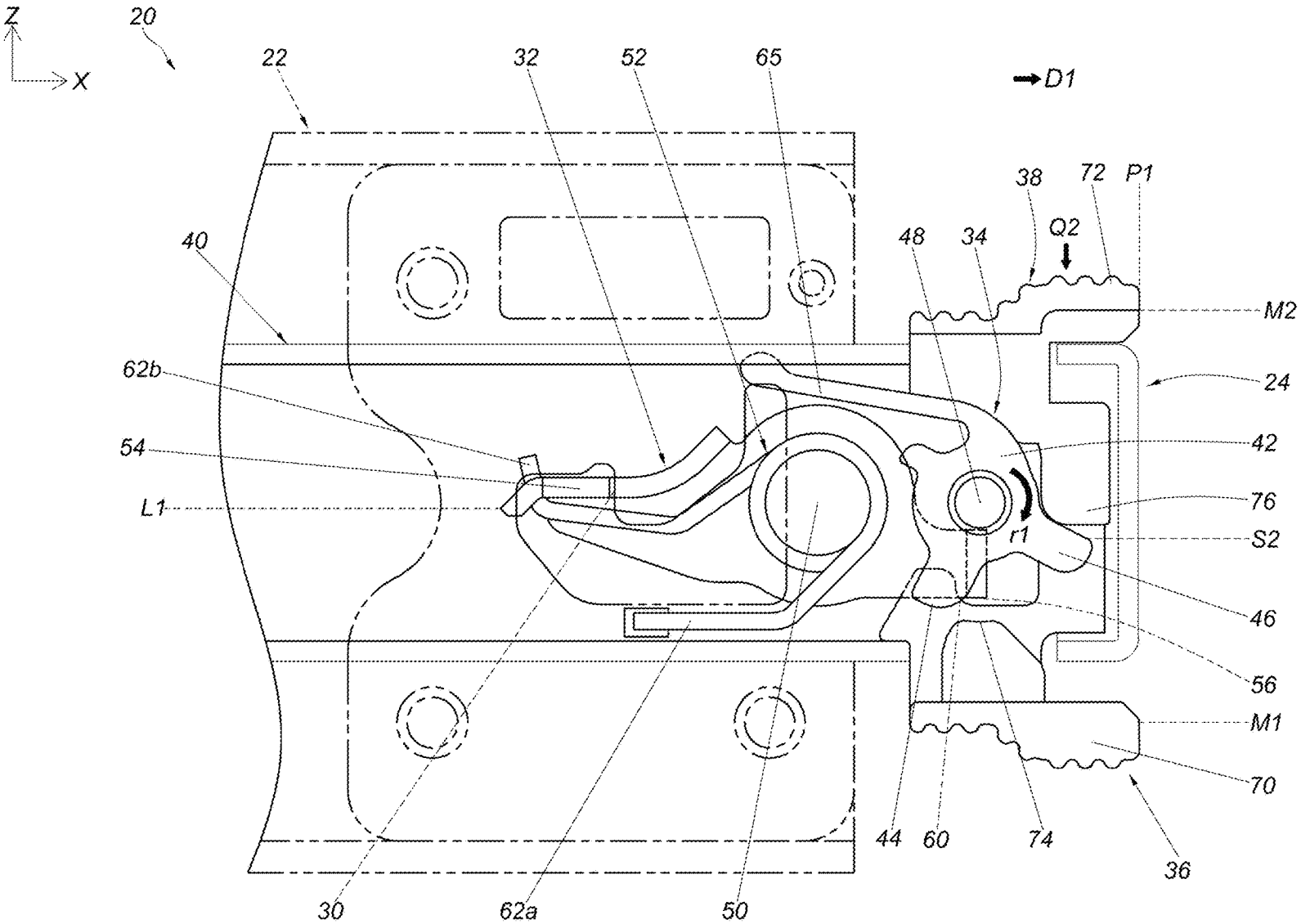
FIG. 6 is a partial diagram of the slide rail assembly, showing the first operating member and the second operating member in the first predetermined state and a second predetermined state, respectively, with the second rail located at the predetermined position relative to the first rail, according to the embodiment of the present invention.

As shown in FIG. 5 and FIG. 6, when the second operating member 38 is operated along a second predetermined direction Q2 opposite to the first predetermined direction Q1, e.g., by pressing the second operating member 38, to move from the first predetermined state M1 (shown in FIG. 5) to a second predetermined state M2 (shown in FIG. 6), the second operating member 38 abuts against the actuating portion 46 with a driving portion 76 to drive the auxiliary member 34 to move from the first state S1 (shown in FIG. 5) to a second state S2 (shown in FIG. 6) through rotation of the main body portion 42 along a first rotating direction r1, which prevents the corresponding portion 74 of the first operating member 36 from being blocked by the blocking portion 44 of the auxiliary member 34, as shown in FIG. 6. For example, when the auxiliary member 34 is in the second state S2, the blocking portion 44 of the auxiliary member 34 is not corresponding to or not aligned with the corresponding portion 74 of the first operating member 36 along the height direction, such that the blocking portion 44 of the auxiliary member 34 fails to block the corresponding portion 74 of the first operating member 36.

Figure 7:
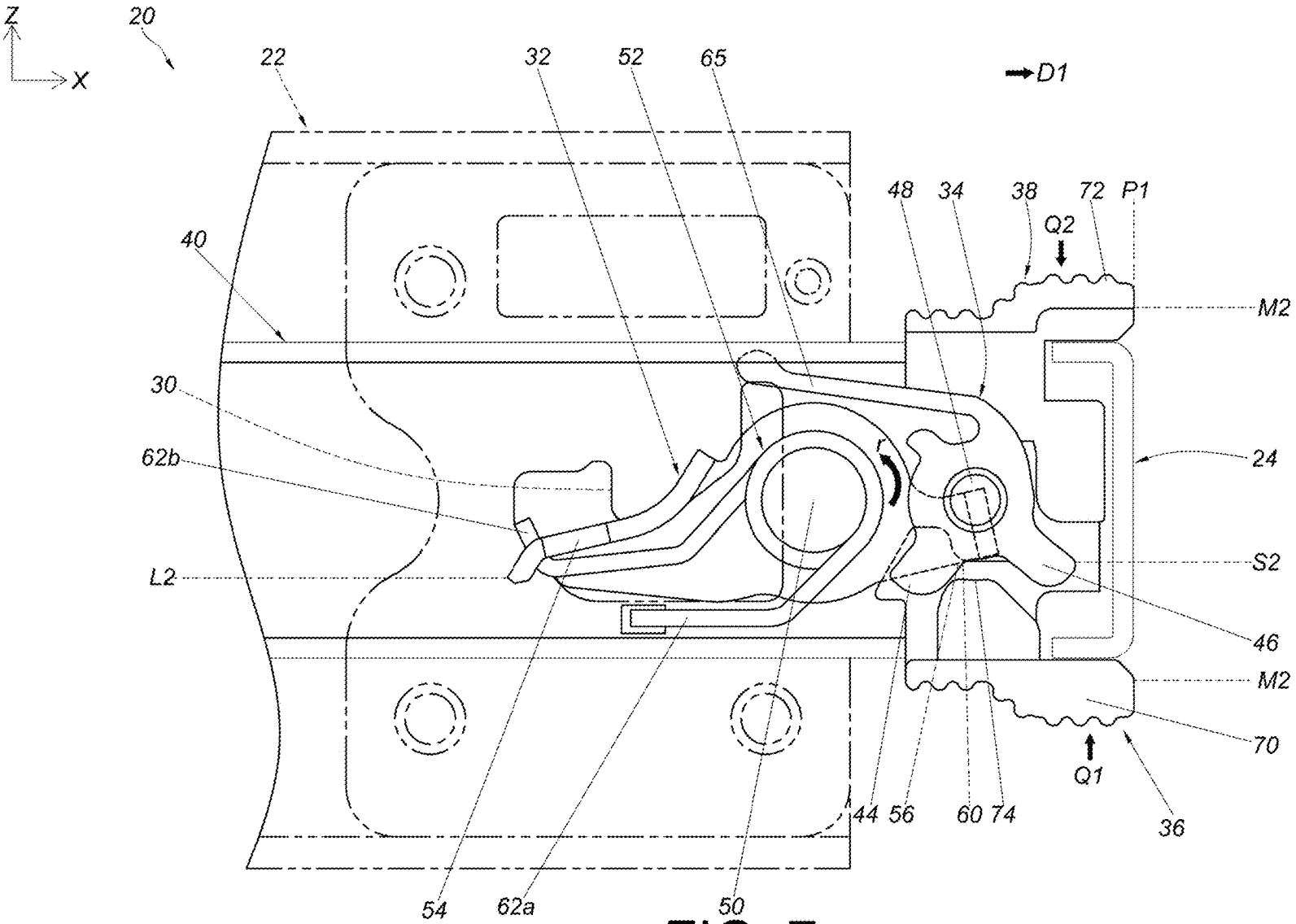
FIG. 7 is a partial diagram of the slide rail assembly, showing both the first operating member and the second operating member in the second predetermined state, with the second rail located at the predetermined position relative to the first rail, according to the embodiment of the present invention.

As shown in FIG. 6 and FIG. 7, when the blocking portion 44 of the auxiliary member 34 fails to block the corresponding portion 74 of the first operating member 36, the first operating member 36 can be operated along the first predetermined direction Q1, e.g., by pressing the first operating member 36, to move from the first predetermined state M1 to the second predetermined state M2 (shown in FIG. 7) to press the working portion 56 of the locking member 32 with the predetermined portion 60, thereby driving the locking member 32 to move from the locking state L1 to an unlocking state L2 (shown in FIG. 7) along a predetermined rotating direction r. When the locking member 32 is in the unlocking state L2, the blocking feature 30 on the first rail 22 fails to block the locking portion 54 of the locking member 32, thereby allowing the second rail 24 to displace away from the predetermined position P1 along the opening direction D1. Specifically, when the locking member 32 is in the unlocking state L2, the locking portion 54 is not corresponding to or not aligned with the blocking feature 30 along the longitudinal direction, i.e., the X axis, such that the blocking feature 30 fails to block the locking portion 54. Besides, when both the first operating member 36 and the second operating member 38 remain pressed in the second predetermined state M2 (shown in FIG. 7), the resilient member 52 and the resilient feature 65 continue accumulating the resilient forces.

Figure 8:
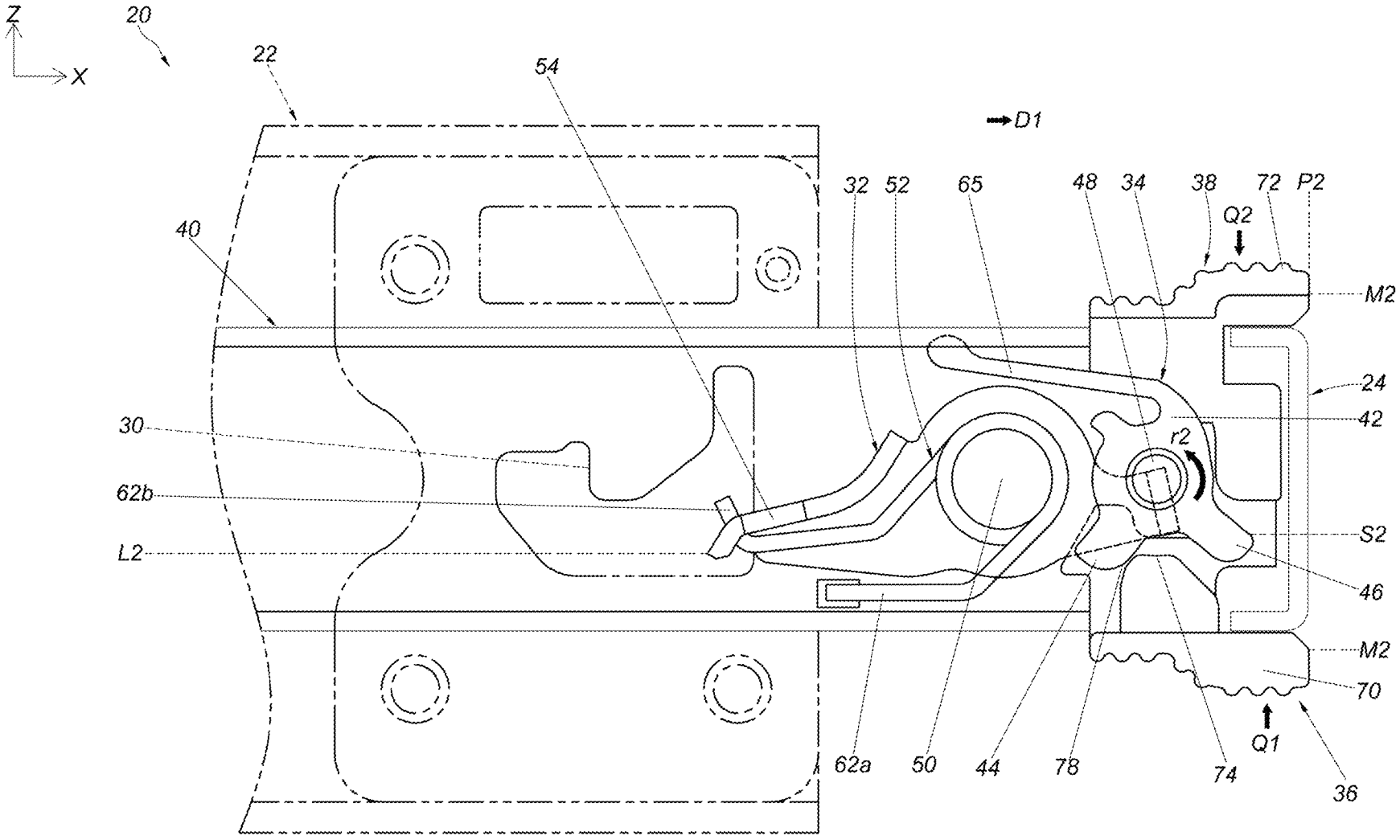
FIG. 8 is a partial diagram of the slide rail assembly, with the second rail located at another predetermined position relative to the first rail, according to the embodiment of the present invention.

As shown in FIG. 7 and FIG. 8, when the locking member 32 is in the unlocking state L2, the second rail 24 can be displaced relative to the first rail 22 away from the predetermined position P1 along the opening direction D1. For example, the second rail 24 can be displaced from the predetermined position P1 to another predetermined position P2, such as an opened position shown in FIG. 8, along the opening direction D1. Furthermore, once the first operating member 36 and the second operating member 38 are released (e.g., when the first operating member 36 and the second operating member 38 are no longer pressed along the first predetermined direction Q1 and the second predetermined direction Q2, respectively), the first operating member 36 and the second operating member 38 can return from the second predetermined state M2 to the first predetermined state M1 in response to the resilient forces provided by the resilient member 52 and the resilient feature 65, respectively.

It should be noticed that the configuration, in which the resilient force provided by the resilient member 52 is greater than the resilient force provided by the resilient feature 65, allows the first operating member 36 and the second operating member 38 to be pressed with forces of different magnitudes by using two fingers, thereby creating a time delay between pressing operations of the first operating member 36 and the second operating member 38 to facilitate sequential operations of the second operating member 38 and the first operating member 36. For example, only after the second operating member 38 has been operated to drive the auxiliary member 34 to prevent the auxiliary member 34 from blocking the first operating member 36, can the first operating member 36 be pressed to drive the locking member 32, thereby preventing the blocking feature 30 from blocking the locking member 32.

Preferably, a guiding section 78 is arranged on one of the blocking portion 44 and the corresponding portion 74. For example, the guiding section 78 can be an arc surface or an inclined surface. In this embodiment, by way of example, the guiding section 78 is arranged on the blocking portion 44. However, the present invention is not limited to this embodiment. The guiding section 78 is configured to facilitate the auxiliary member 34 to pass over the corresponding portion 74 to move to the first state S1 when the auxiliary member 34 returns from the second state S2 to the first stat S1 through rotation of the main body portion 42 along a second rotating direction r2 opposite to the first rotating direction r1.

From the above, the slide rail assembly 20 of the present invention includes the following characteristics.

1. The auxiliary member 34 acts as a safety lock to block the first operating member 36, thereby preventing the first operating member 36 from being operated to drive the locking member 32, if the second operating member 38 is not properly operated. Accordingly, only after the second operating member 38 has been operated to drive the auxiliary member 34 from the first state S1 to the second state S2 to prevent the first operating member 36 from being blocked by the auxiliary member 34, can the first operating member 36 be operated to drive the locking member 32 from the locking state L1 to the unlocking state L2, which results in preventing the locking portion 54 of the locking member 32 from being blocked by the blocking feature 30, thereby allowing the second rail 24 to displace relative to the first rail 22 away from the predetermined position P1 along the opening direction D1. Since the locking member 32 can only move from the locking state L1 to the unlocking state L2 through the sequential operations of the second operating member 38 and the first operating member 36, the slide rail assembly 20 ensures operational safety.
2. The configuration, in which the resilient force provided by the resilient member 52 is greater than the resilient force provided by the resilient feature 65, creates a time delay between the pressing operations of the first operating member 36 and the second operating member 38 with forces of different magnitudes by using two fingers, thereby facilitating the sequential operations of the second operating member 38 and the first operating member 36.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A slide rail assembly comprising:

a first rail;

a second rail displaceable relative to the first rail;

a blocking feature arranged on the first rail;

a first operating member movably located on the second rail;

a second operating member movably located on the second rail;

an auxiliary member movably located on the second rail; and a locking member movably located on the second rail;

wherein when the second rail is located at a predetermined position relative to the first rail, the blocking feature is configured to block the locking member in a locking state for preventing the second rail from displacing away from the predetermined position;

wherein when the auxiliary member is in a first state, the auxiliary member is configured to block the first operating member, thereby preventing the first operating member from being operated to drive the locking member from the locking state to an unlocking state;

wherein the second operating member is configured to be operated to drive the auxiliary member from the first state to a second state for preventing the first operating member from being blocked by the auxiliary member, thereby allowing the first operating member to be operated to drive the locking member from the locking state to the unlocking state for allowing the second rail to displace away from the predetermined position.

2. The slide rail assembly of claim 1, wherein the second rail comprises a first end portion and a second end portion opposite to the first end portion, and the first operating member, the second operating member, the auxiliary member and the locking member are movably mounted on the second rail and adjacent to the first end portion of the second rail.

3. The slide rail assembly of claim 1, wherein the auxiliary member comprises a main body portion, a blocking portion and an actuating portion, the main body portion is pivotally connected to the second rail, the blocking portion and the actuating portion are arranged on the main body portion, when the auxiliary member is in the first state, the blocking portion of the auxiliary member is configured to block a corresponding portion of the first operating member, thereby preventing the first operating member from being operated to drive the locking member from the locking state to the unlocking state, and the second operating member is configured to be operated to abut against the actuating portion to drive the auxiliary member from the first state to the second state for preventing the corresponding portion of the first operating member from being blocked by the blocking portion of the auxiliary member, thereby allowing the first operating member to be operated to drive the locking member from the locking state to the unlocking state.

4. The slide rail assembly of claim 3, wherein a guiding section is arranged on one of the blocking portion and the corresponding portion and configured to facilitate the auxiliary member to pass over the corresponding portion when the auxiliary member moves from the second state to the first state.

5. The slide rail assembly of claim 3, further comprising a resilient feature configured to provide a resilient force for resiliently retaining the auxiliary member in the first state, and the actuating portion of the auxiliary member in the first state being configured to support the second operating member to retain the second operating member in a first predetermined state.

6. The slide rail assembly of claim 5, wherein the locking member is pivotally connected to the second rail.

7. The slide rail assembly of claim 6, further comprising a resilient member configured to provide a resilient force for resiliently retaining the locking member in the locking state, and the locking member in the locking state being configured to support the first operating member to retain the first operating member in the first predetermined state, and the resilient force provided by the resilient member is greater than the resilient force provided by the resilient feature.

8. The slide rail assembly of claim 7, wherein the first operating member comprises a first operating portion for allowing a pressing operation of the first operating member, and the second operating member comprises a second operating portion for allowing a pressing operation of the second operating member.

9. The slide rail assembly of claim 8, wherein the first operating portion and the second operating portion are located adjacent to a first height position and a second height position relative to the second rail, respectively.

10. The slide rail assembly of claim 3, wherein the main body portion of the auxiliary member is located between the first operating member and the second operating member.

11. A slide rail assembly comprising:

a first rail;

a second rail displaceable relative to the first rail;

a blocking feature arranged on the first rail;

a first operating member movably located on the second rail;

a second operating member movably located on the second rail;

an auxiliary member movably located on the second rail; and a locking member movably located on the second rail;

wherein when the second rail is located at a predetermined position relative to the first rail, the blocking feature is configured to block the locking member in a locking state for preventing the second rail from displacing away from the predetermined position;

wherein when the auxiliary member is in a first state, the auxiliary member is configured to block the first operating member, thereby preventing the first operating member from being pressed along a first predetermined direction to drive the locking member from the locking state to an unlocking state;

wherein when the second operating member is pressed along a second predetermined direction opposite to the first predetermined direction, the second operating member is configured to drive the auxiliary member from the first state to a second state, thereby allowing the first operating member to be pressed along the first predetermined direction to drive the locking member from the locking state to the unlocking state.

12. The slide rail assembly of claim 11, wherein the second rail comprises a first end portion and a second end portion opposite to the first end portion, and the first operating member, the second operating member, the auxiliary member and the locking member are movably mounted on the second rail and adjacent to the first end portion of the second rail.

13. The slide rail assembly of claim 11, wherein the auxiliary member comprises a main body portion, a blocking portion and an actuating portion, the main body portion is pivotally connected to the second rail, the blocking portion and the actuating portion are arranged on the main body portion, when the auxiliary member is in the first state, the blocking portion of the auxiliary member is configured to block the first operating member, thereby preventing the first operating member from being pressed to drive the locking member from the locking state to the unlocking state, and the second operating member is configured to be pressed to abut against the actuating portion to drive the auxiliary member from the first state to the second state for preventing the first operating member from being blocked by the blocking portion of the auxiliary member, thereby allowing the first operating member to drive the locking member from the locking state to the unlocking state for allowing the second rail to displace away from the predetermined position.

14. The slide rail assembly of claim 13, further comprising a resilient feature configured to provide a resilient force for resiliently retaining the auxiliary member in the first state.

15. The slide rail assembly of claim 13, wherein the main body portion is located between the first operating member and the second operating member.

16. The slide rail assembly of claim 11, wherein the locking member is pivotally connected to the second rail, and the slide rail assembly further comprises a resilient member configured to provide a resilient force for resiliently retaining the locking member in the locking state.

17. A slide rail assembly comprising:

a first rail;

a second rail displaceable relative to the first rail;

a blocking feature arranged on the first rail;

a first operating member movably located on the second rail;

a second operating member movably located on the second rail;

an auxiliary member movably located on the second rail, the auxiliary member comprising a main body portion, a blocking portion and an actuating portion, the blocking portion and the actuating portion being arranged on the main body portion;

a locking member movably located on the second rail; and a resilient member;

wherein when the second rail is located at a predetermined position relative to the first rail, the blocking feature is configured to block the locking member in a locking state for preventing the second rail from displacing away from the predetermined position;

wherein when the auxiliary member is in a first state, the blocking portion of the auxiliary member is configured to block a corresponding portion of the first operating member, thereby preventing the first operating member from being pressed along a first predetermined direction to drive the locking member;

wherein when the second operating member is pressed along a second predetermined direction opposite to the first predetermined direction, the second operating member is configured to drive the auxiliary member from the first state to a second state for preventing the corresponding portion of the first operating member from being blocked by the blocking portion of the auxiliary member, thereby allowing the first operating member to be pressed along the first predetermined direction to drive the locking member from the locking state to an unlocking state for allowing the second rail to displace away from the predetermined position;

wherein the resilient member is configured to provide a resilient force for resiliently retaining the locking member in the locking state, and the locking member in the locking state is configured to support the first operating member.

18. The slide rail assembly of claim 17, further comprising a resilient feature configured to provide a resilient force for resiliently retaining the auxiliary member in the first state, and the actuating portion of the auxiliary member in the first state being configured to support the second operating member.

19. The slide rail assembly of claim 18, wherein the resilient force provided by the resilient member is greater than the resilient force provided by the resilient feature.

20. The slide rail assembly of claim 18, wherein the second rail comprises a first restraining portion and a second restraining portion configured to respectively restrain the first operating member and the second operating member in a first predetermined state.

* * * * *